US012228013B2

(12) United States Patent
Borschneck et al.

(10) Patent No.: US 12,228,013 B2
(45) Date of Patent: Feb. 18, 2025

(54) SYSTEM AND METHOD FOR INCREASING FORCE ON DOWNHOLE TOOL

(71) Applicant: Schlumberger Technology Corporation, Sugar Land, TX (US)

(72) Inventors: Sean Gray Borschneck, Calgary (CA); Matthew Carroll McCarthy, Calgary (CA)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/690,325

(22) PCT Filed: Oct. 25, 2022

(86) PCT No.: PCT/US2022/047679
§ 371 (c)(1),
(2) Date: Mar. 8, 2024

(87) PCT Pub. No.: WO2023/076230
PCT Pub. Date: May 4, 2023

(65) Prior Publication Data

US 2024/0426191 A1 Dec. 26, 2024

Related U.S. Application Data

(60) Provisional application No. 63/271,778, filed on Oct. 26, 2021.

(51) Int. Cl.
*E21B 34/14* (2006.01)

(52) U.S. Cl.
CPC ..... *E21B 34/14* (2013.01)

(58) Field of Classification Search
CPC ..... E21B 34/14
See application file for complete search history.

(56) References Cited

U.S. PATENT DOCUMENTS 3,848,668 A * 11/1974 Sizer ..... E21B 34/14 166/299
8,371,389 B2 * 2/2013 Hofman ..... E21B 34/14 175/286

(Continued)

FOREIGN PATENT DOCUMENTS

WO 2014175890 A1 10/2014
WO 2020086986 A1 4/2020

OTHER PUBLICATIONS

Search Report and Written Opinion of International Patent Application No. PCT/US2022/047679 on Feb. 23, 2023; 12 pages.

*Primary Examiner* — Steven A MacDonald
(74) *Attorney, Agent, or Firm* — Jeffrey D. Frantz

(57) ABSTRACT

A technique facilitates application of increased force on a downhole tool, such as a shifting tool. According to an embodiment, a shifting tool is sized for deployment along the interior of a well string to enable shifting of a sliding sleeve. The shifting tool comprises a plurality of keys which are movably mounted for actuation between a contracted position and an extended position engaging the sliding sleeve. A plurality of pads may be actuated with the plurality of keys so as to form a flow restriction between the shifting tool and the surrounding well string. As a result, fluid pumped down between the shifting tool and the well string establishes a pressure differential across the flow restriction which helps move the shifting tool and the sliding sleeve to a desired position.

15 Claims, 4 Drawing Sheets

(56) References Cited

U.S. PATENT DOCUMENTS

| | | | | |
|---|---|---|---|---|
| 2011/0308817 | A1* | 12/2011 | Ravensbergen | E21B 33/138 166/120 |
| 2014/0174761 | A1* | 6/2014 | Spencer | E21B 17/1014 166/381 |
| 2020/0040679 | A1* | 2/2020 | Mauchien | E21B 23/01 |
| 2024/0183248 | A1* | 6/2024 | Wai | E21B 23/01 |

* cited by examiner

SYSTEM AND METHOD FOR INCREASING FORCE ON DOWNHOLE TOOL

CROSS-REFERENCE TO RELATED APPLICATIONS

This application is a National Stage Entry of International Application No. PCT/US2022/047679, filed Oct. 24, 2022, which claims the benefit of U.S. Provisional Application No. 63/271,778 entitled "System and Method for Increasing Force on Downhole Tool," filed Oct. 26, 2021, the disclosure of which is incorporated herein by reference in its entirety.

BACKGROUND

In many oil and gas well applications, a wellbore is drilled into the earth and through a reservoir of the desired fluid, e.g. oil and/or gas. Production of the desired fluid may be enhanced by performing fracturing operations at individual stages of the well. The fracturing operations as well as other well related operations may involve the shifting of sliding sleeves to open and close off flow with respect to the individual stages. A shifting tool may be run downhole through a well string to engage and shift the desired sliding sleeves. However, with larger horizontal wellbore lengths the ability to provide sufficient weight or force on the shifting tool so as to shift the sliding sleeve becomes more limited.

SUMMARY

In general, a system and methodology facilitate application of increased force on a downhole tool, such as a shifting tool. According to an embodiment, a shifting tool is sized for deployment along the interior of a well string to enable shifting of a sliding sleeve. The shifting tool comprises a plurality of keys which are movably mounted for actuation between a contracted position and an extended position engaging the sliding sleeve. A plurality of pads may be actuated with the plurality of keys so as to form a flow restriction between the shifting tool and the surrounding well string. As a result, fluid pumped down between the shifting tool and the well string establishes a pressure differential across the flow restriction which helps move the shifting tool and thus the sliding sleeve to a desired position.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. It should be understood, however, that these embodiments are provided only as examples for the purpose of illustrating the various implementations described herein. They are not meant to limit the scope of various technologies described herein. It will be understood by those of ordinary skill in the art that the system and/or methodology may be practiced without these details and that numerous variations or modifications from the described embodiments may be possible.

The disclosure herein generally involves a system and methodology which facilitate application of increased force on a downhole tool, such as a shifting tool. According to an embodiment, a shifting tool is sized for deployment along the interior of a well string to enable shifting of a sliding sleeve. It should be noted the shifting tool may be repeatedly actuated between operational configurations to enable shifting of a given sliding sleeve and then movement to subsequent sliding sleeves for additional shifting operations. Additionally, the mechanisms described herein to enable application of increased force may be utilized with a variety of different types of downhole tools to facilitate movement of the downhole tool along extended horizontal sections of wellbores or along other difficult wellbore sections.

In some embodiments, the shifting tool comprises at least one key, e.g. a plurality of keys, movably mounted in a tool housing for actuation between a contracted position and an extended position engaging the sliding sleeve. Additionally, at least one pad, e.g. a plurality of pads, may be actuated with the plurality of keys so as to form a flow restriction between the shifting tool and the surrounding well string. As a result, fluid pumped down between the shifting tool and the well string establishes a pressure differential across the flow restriction. This pressure differential can be used to help move the shifting tool and thus shift the sliding sleeve to a desired position.

Figure 1:
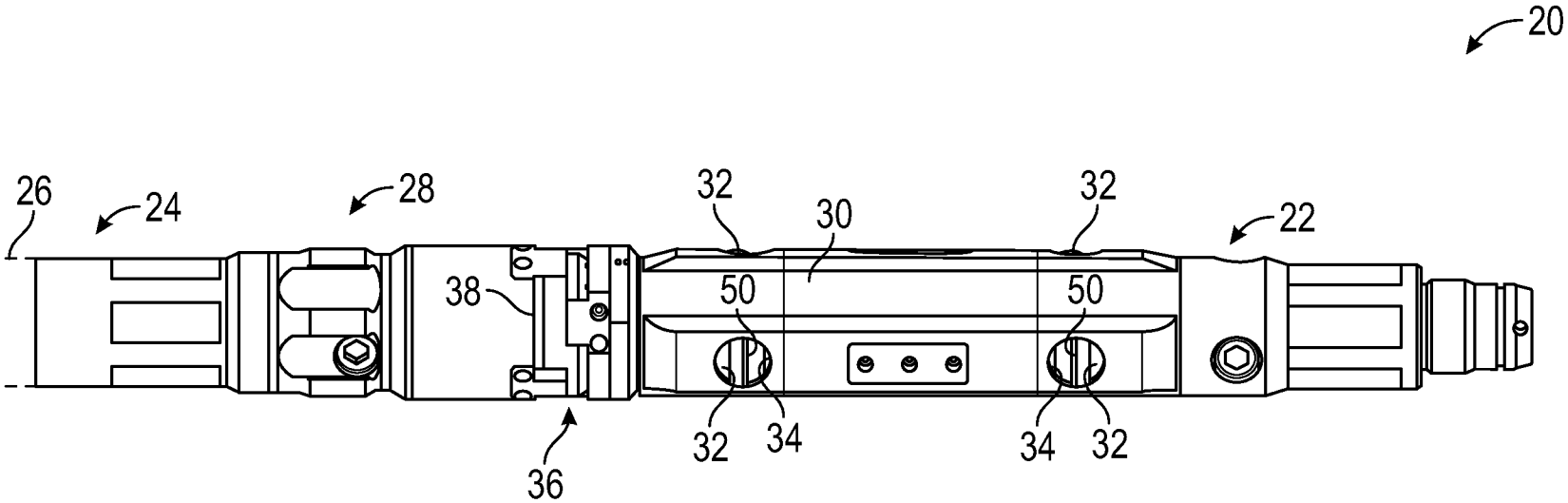
FIG. 1 is a front view of an example of a downhole tool constructed to facilitate application of increased force during movement downhole, according to an embodiment of the disclosure.

Referring generally to FIG. 1, an example of a downhole tool 20 is illustrated. In this example, the downhole tool 20 is in the form of a shifting tool 22 which may be coupled with a coil tubing string 24 comprising, for example, coil tubing 26 and various other components, such as a centralizer 28. The coil tubing 26 may be used to deploy the shifting tool 22 downhole to desired locations so that the shifting tool 22 may be actuated to perform sliding sleeve shifting operations and/or other shifting operations.

Figure 2:
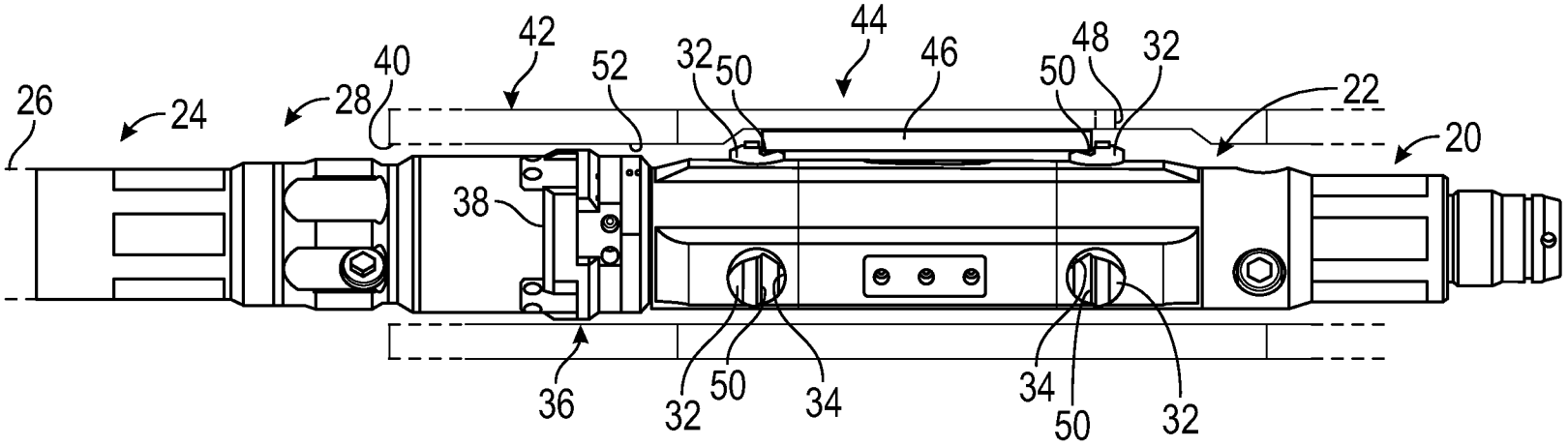
FIG. 2 is an illustration of the downhole tool shown in FIG. 1 deployed downhole to shift a sliding sleeve, according to an embodiment of the disclosure.

According to an embodiment, shifting tool 22 may comprise a shifting tool housing 30 in which at least one key 32 is movably mounted. In the illustrated example, a plurality of the keys 32 is movably mounted in the shifting tool housing 30 for actuation between a contracted position, as illustrated in FIG. 1, and an extended position, as illustrated in FIG. 2. In the specific example illustrated, the keys 32 are transitioned radially through corresponding openings 34 of shifting tool housing 30 between a radially inward position (FIG. 1) and a radially outward position (FIG. 2).

As illustrated, the shifting tool 22 also comprises at least one pad 36 which may be actuated to create a flow restriction. In the embodiment illustrated, the shifting tool 22 comprises a plurality of the pads 36 which may be selectively actuated between a contracted position, as illustrated in FIG. 1, and an extended position, as illustrated in FIG. 2. The pads 36 also may be movably mounted in an opening or openings 38 of shifting tool housing 30 to enable radial movement between the contracted and extended positions. It should be noted that shifting tool housing 30 may be formed as a single housing or as a plurality of combined sub housings. For example, the keys 32 may be mounted in one sub housing and the pads 36 may be mounted in an adjoining sub housing of the overall shifting tool housing 30.

Referring again to FIG. 2, the shifting tool 22 is illustrated as deployed downhole via coil tubing 26 along an interior 40 of a well string 42. In this example, the well string 42 comprises a sliding sleeve assembly 44 having a sliding sleeve 46 which may be shifted linearly via shifting tool 22. The sliding sleeve 46 may be shifted between an open flow position exposing a plurality of flow ports 48 and a closed flow position blocking the plurality of flow ports 48. In the open flow position, fluid flow is permitted between an interior and exterior of the well string 42 while in the closed flow position such fluid flow is blocked.

In FIG. 2, the sliding sleeve 46 is illustrated in the open flow position and shifting tool 22 is illustrated as actuated so the keys 32 and pads 36 have been moved to the radially extended position. In this configuration, sleeve coupling features 50 of the keys 32 are positioned to engage the sliding sleeve 46 to facilitate linear sliding of the sliding sleeve 46 as the shifting tool 22 is moved linearly along interior 40 of well string 42. The sleeve coupling features 50 may be oriented to facilitate movement of sleeve 46 in either a downhole or an uphole direction.

Because the illustrated pads 36 have been extended into proximity with a surrounding well string wall 52, a restriction is established. In the illustrated example, the keys 32 are constructed to extend radially outward to a diameter larger than the diameter of the surrounding well string wall 52 so as to engage the sliding sleeve 46. However, when the keys 32 are transitioned to the radially inward contracted position they are able to move through the smaller diameter of surrounding well string wall 52.

When fluid is pumped down between coiled tubing string 24/shifting tool 22 and the surrounding well string 42, a differential pressure is created across the radially extended pads 36. The differential pressure effectively creates a force that helps move the shifting tool 22 in a direction which transitions the sliding sleeve 46 from the open flow position to the closed flow position. The radially extended keys 32 ensure that sleeve coupling features 50 remain engaged with the sliding sleeve 46 so that the sliding sleeve 46 is forced to move with the linearly moving shifting tool 22.

Once the sliding sleeve 46 is in the closed position, the shifting tool 22 may once again be actuated to move the keys 32 and pads 36 to a contracted position. For example, the keys 32 and pads 36 may be retracted radially inward. This allows the shifting tool 22 to be moved along the interior of well string 42 to, for example, a subsequent sliding sleeve. In this manner, the shifting tool 22 may be actuated between contracted positions and expanded positions to shift sequential sliding sleeves 46 with the aid of forces created by differential pressures established across the extended pads 36.

Figure 3:
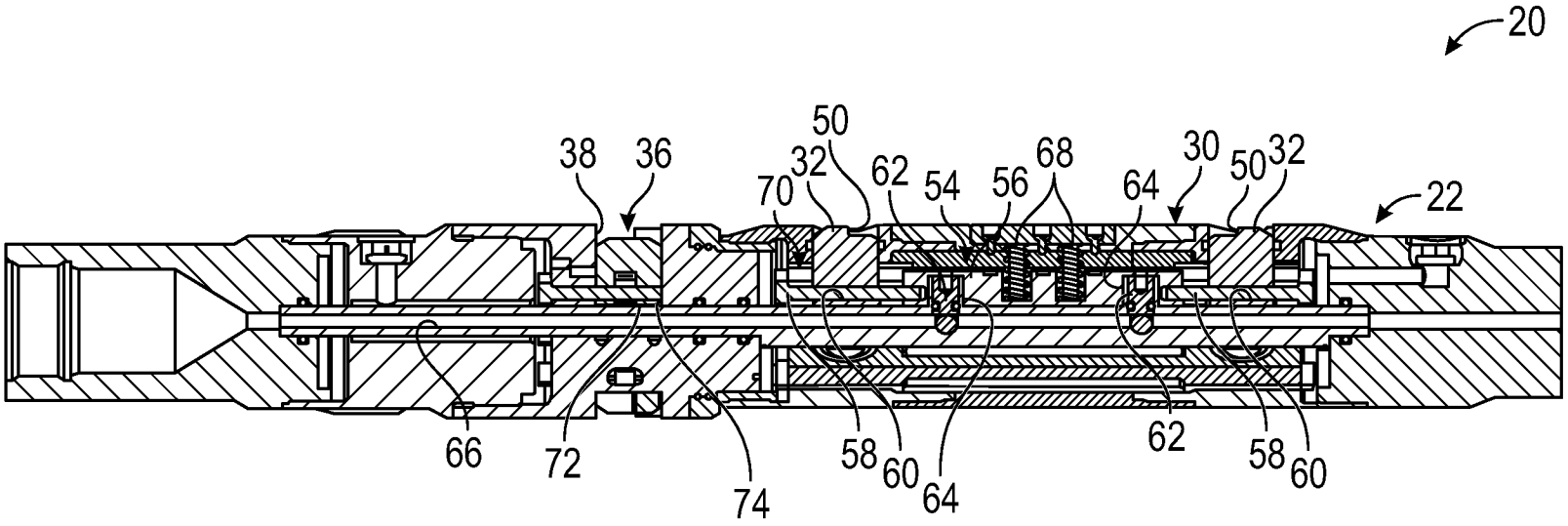
FIG. 3 is a cross-sectional view of the downhole tool illustrated in FIG. 1, according to an embodiment of the disclosure.

Referring generally to FIG. 3, a cross-sectional illustration is provided of an example of the shifting tool 22 in which keys 32 and pads 36 have been linked via a mechanical linkage system 54. In this type of embodiment, the keys 32 and the pads 36 are linked so as to move together as they shift radially outward to the extended position and radially inward to the contracted position. By way of example, the mechanical linkage system 54 may comprise a plurality of linkage bars 56 which link specific pads 36 and keys 32. For example, each linkage bar 56 may be connected between an individual pad 36 and a pair of keys 32, e.g. the pair of keys positioned and oriented to engage opposing sides of the sliding sleeve 46.

In the illustrated embodiment, each linkage bar 56 engages the corresponding pair of keys 32 via rotatable rods 58 extending through corresponding bores 60 disposed through the individual keys 32. The linkage bar 56 may be hydraulically actuated to shift the keys 32 from the radially contracted position illustrated in FIG. 3 to the radially extended position illustrated in FIG. 4. However, other types of actuation mechanisms, e.g. mechanical or electro-mechanical actuation mechanisms may be employed.

In the hydraulic actuation example illustrated, a hydraulic piston 62 or a plurality of hydraulic pistons 62 may be slidably mounted in corresponding piston cylinders 64 and oriented to act against linkage bar 56. The hydraulic pistons 62 are acted on by hydraulic actuating fluid supplied via a hydraulic line 66 routed down through the coil tubing 26 and along an interior of shifting tool 22. With sufficient pressure, the hydraulic actuating fluid may be used to force the pistons 62 in a radially outward direction, thus forcing the corresponding linkage bars 56 in the radially outward direction. According to the example illustrated, the pistons 62 associated with each of the linkage bars 56 receive the hydraulic actuating fluid simultaneously which causes the linkage bars 56 and are associated keys 32 to move in a radially outward direction simultaneously.

It should be noted the linkage bars 56 may be spring biased toward the radially contracted position. In the example illustrated, a spring 68 or springs 68 may be positioned between each linkage bar 26 and the surrounding shifting tool housing 30. The springs 68 may be coil springs or other suitable springs which compress as the keys 32 are shifted to the extended position. When the hydraulic pressure in hydraulic line 66 is released, the springs 68 are able to force the corresponding linkage bars 56 and the keys 32 back to the contracted position.

As described above, the pads 36 move radially outward and radially inward in conjunction with the keys 32. The linkage bars 56 may be constructed to link the pads 36 with corresponding keys 32 directly or via various mechanisms. For example, a given linkage bar 56 connecting a pair of keys 32 with a corresponding pad 36 may utilize a cam system 70 to provide the desired movement of the corresponding pad 36.

Figure 4:
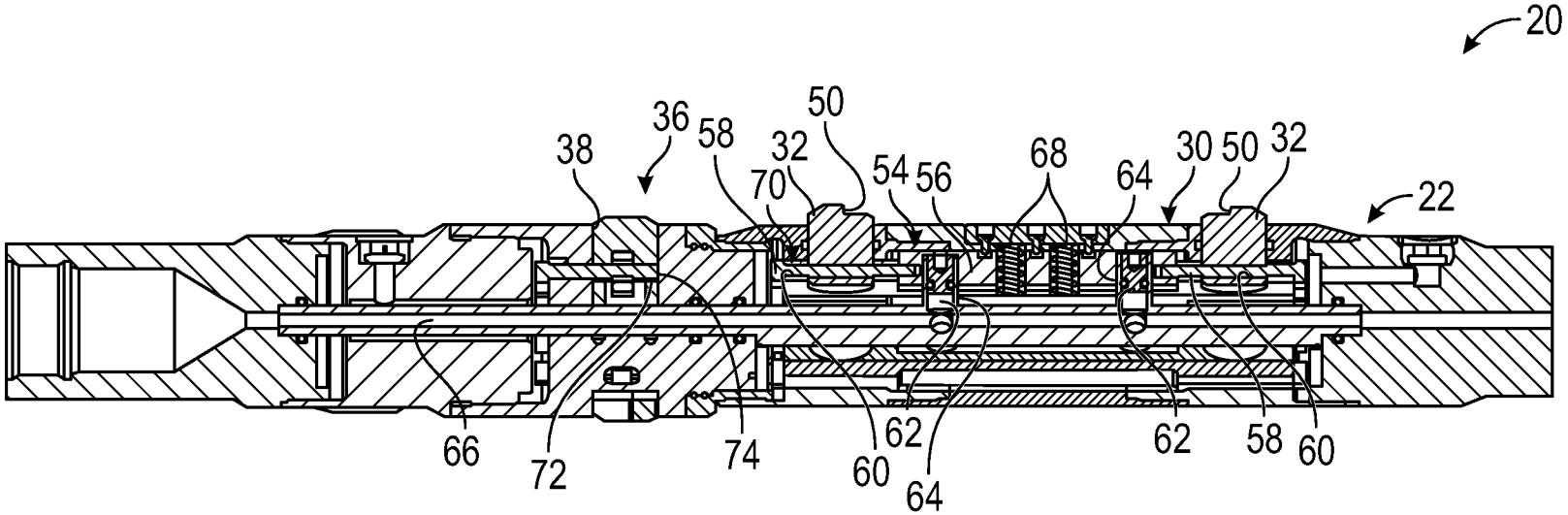
FIG. 4 is a cross-sectional view similar to that of FIG. 3 but showing the downhole tool in a different operational configuration, according to an embodiment of the disclosure.

Various types of cam systems 70 or other translation mechanisms may be used to provide the simultaneous movement of pad 36 between contracted and extended positions. As the linkage bar 56 is shifted from the contracted position illustrated in FIG. 3 to the extended position illustrated in FIG. 4, the cam system 70 pivots. This motion forces a slide member 72 of the pad 36 to slide in a radially outward direction from the contracted position to the extended position. FIGS. 3 and 4 show this transition from contracted to extended positions of the pad 36, along with keys 32, as slide member 72 is guided radially outward via a slide path 74 formed in shifting tool housing 30.

It should be noted that linkage bar 56 may be constructed as a direct connection between pad 36 and the associated keys 32 or it may utilize various other mechanisms to achieve the simultaneous movement. Use of cam system 70 or other types of transition systems enables adjustment of, for example, the radial distance traveled by pad 36 relative to the corresponding keys 32. In other systems, different numbers of pads 36 and keys 32 may be linked. Additionally, the pads 36 and keys 32 may be individually actuated hydraulically or via other suitable actuation techniques.

Depending on the parameters of a given well operation, length of the wellbore, and environmental considerations, the construction and components of the well string 42 and coil tubing string 24 may vary. Additionally, the size and configuration of the downhole tool 20 may be selected according to the requirements of a given well operation. The extendable pads 36 may be used with a variety of downhole tools 20 to facilitate movement of the downhole tool 20 in horizontal wellbores or other challenging types of boreholes.

In various fracturing operations, production operations, and/or other downhole operations the downhole tool 20 may be in the form of shifting tool 22 constructed to facilitate shifting of one or more sliding sleeves 46 disposed along the well string 42. The shifting tool 22 may be constructed with various numbers of shiftable keys 32 and shiftable pads 36 which may be hydraulically shifted, mechanically shifted, electro-mechanically shifted, or otherwise shifted between the desired contracted and extended positions. In some embodiments, sets of shiftable keys 32 and shiftable pads 36 may be tied together by various types of linkage bars 56 or other mechanisms to ensure simultaneous movement of corresponding keys 32 and pads 36.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a shifting tool sized for deployment along an interior of a well string to shift a sliding sleeve, the shifting tool comprising:

a shifting tool housing;

a plurality of keys movably mounted in the shifting tool housing to hydraulically move between a radially inward key position and a radially outward key position engaging the sliding sleeve; and a plurality of pads mechanically linked with the plurality of keys, which move radially with the plurality of keys between a radially inward pad position allowing fluid flow between the shifting tool and the well string and a radially outward pad position restricting fluid flow between the shifting tool and the well string to create a differential pressure across the plurality of pads, thus assisting in movement of the shifting tool and corresponding shifting of the sliding sleeve.

2. The system as recited in claim 1, wherein the shifting tool is deployed along the interior of the well string via a coil tubing.

3. The system as recited in claim 2 wherein the plurality of keys is moved hydraulically via hydraulic actuating fluid supplied by a hydraulic line routed along an interior of the coil tubing and the shifting tool.

4. The system as recited in claim 3, wherein the plurality of pads is mechanically linked to the plurality of keys by using linkage bars coupling individual pads with corresponding pairs of keys.

5. The system as recited in claim 4, wherein the linkage bars are spring biased to move the plurality of keys to the radially inward key position until sufficient hydraulic actuation pressure is applied to shift the plurality of keys to the radially outward key position.

6. The system as recited in claim 2, wherein each key of the plurality of keys comprises a sliding sleeve coupling feature.

7. The system as recited in claim 6, wherein the sliding sleeve coupling features are oriented to aid in shifting the sliding sleeve in a downhole direction and an uphole direction.

8. A system, comprising:

a well string deployed in a borehole, the well string having a sliding sleeve slidable between positions allowing flow through a flow port and blocking flow through the flow port; and a shifting tool deployed down through an interior of the well string by coil tubing, the shifting tool comprising:

a plurality of keys hydraulically shiftable into a position engaging the sliding sleeve;

a plurality of pads which shift with the plurality of keys such that the plurality of pads restricts flow between the shifting tool and the well string to facilitate use of fluid pressure between the shifting tool and the well string when shifting the sliding sleeve to a different position; and a mechanical linkage system linking the plurality of keys with the plurality of pads.

9. The system as recited in claim 8, wherein the keys of the plurality of keys are shiftable hydraulically from a radially contracted position in a shifting tool housing to a radially extended position engaging the sliding sleeve.

10. The system as recited in claim 9, wherein each key of the plurality of keys comprises a sliding sleeve coupling feature.

11. The system as recited in claim 9, wherein the mechanical linkage system comprises a plurality of linkage bars.

12. The system as recited in claim 11, wherein the shifting tool comprises springs which act against the linkage bars so as to bias the plurality of keys toward the radially contracted position.

13. The system as recited in claim 11, wherein each linkage bar connects an individual pad with a pair of keys.

14. A method, comprising:

coupling a shifting tool with coil tubing;

deploying the shifting tool down through a well string to a sliding sleeve mounted in the well string;

actuating the shifting tool to hydraulically move at least one key into engagement with the sliding sleeve;

placing a linkage system between the at least one key and at least one pad of the shifting tool such that actuating the shifting tool to move the at least one key causes further actuation of the at least one pad to provide a flow restriction between the shifting tool and the well string; and pumping down fluid against the flow restriction to facilitate movement of the shifting tool and consequent shifting of the sliding sleeve to a new position.

15. The method as recited in claim 14, further comprising moving the shifting tool along the well string to a subsequent sliding sleeve after shifting the sliding sleeve.

* * * * *